US006300597B1

(12) United States Patent
Lee

(10) Patent No.: US 6,300,597 B1
(45) **Date of Patent: *Oct. 9, 2001**

(54) ELECTROMAGNETIC FIELD SHIELDING ELECTRIC HEATING PAD

(76) Inventor: Myoung Jun Lee, 18403 Bechard Ave., Cerritos, CA (US) 90703

( * ) Notice: Subject to any disclaimer, the term of this patent is extended or adjusted under 35 U.S.C. 154(b) by 0 days.

This patent is subject to a terminal disclaimer.

(21) Appl. No.: 09/545,629

(22) Filed: Apr. 7, 2000

Related U.S. Application Data

(63) Continuation-in-part of application No. 09/192,957, filed on Nov. 16, 1998, which is a continuation-in-part of application No. 08/785,981, filed on Jan. 27, 1997, now Pat. No. 5,837,971.

(51) Int. Cl.[7] ..... H05B 1/00

(52) U.S. Cl. ..... 219/212; 219/529; 219/544; 219/546; 219/549

(58) Field of Search ..... 219/211, 212, 219/217, 528, 529, 544, 546, 549, 553; 338/214, 299, 302, 303, 321

(56) References Cited

U.S. PATENT DOCUMENTS

| | | | | |
|---|---|---|---|---|
| 982,735 | | 1/1911 | McElroy . | |
| 1,415,240 | | 5/1922 | Hynes . | |
| 2,527,026 | | 10/1950 | Mucher | 201/71 |
| 3,227,986 | | 1/1966 | Serdahely et al. | 338/302 |
| 3,564,203 | * | 2/1971 | Naoi et al. | 219/212 |
| 3,621,203 | * | 11/1971 | Geominy et al. | 219/549 |
| 3,646,322 | | 2/1972 | Speekman | 219/549 |
| 3,657,520 | * | 4/1972 | Ragault | 219/553 |
| 3,784,784 | * | 1/1974 | Geominy et al. | 219/549 |
| 3,898,427 | | 8/1975 | Levin et al. | 219/522 |
| 4,277,670 | * | 7/1981 | Mori et al. | 219/212 |
| 4,281,237 | | 7/1981 | Berenson | 219/511 |
| 4,309,597 | * | 1/1982 | Crowley | 219/549 |
| 4,575,620 | * | 3/1986 | Ishii et al. | 219/549 |
| 4,577,094 | | 3/1986 | Mills | 219/505 |
| 4,672,176 | * | 6/1987 | Kishimoto et al. | 219/212 |
| 4,684,785 | * | 8/1987 | Cole | 219/212 |
| 4,742,212 | | 5/1988 | Ishii et al. | 219/549 |
| 4,792,663 | | 12/1988 | Kishimoto et al. | 219/549 |
| 4,885,456 | | 12/1989 | Tanaka et al. | 219/497 |
| 4,910,391 | | 3/1990 | Rowe | 219/549 |
| 5,170,043 | | 12/1992 | Gunnufson | 219/528 |
| 5,206,485 | * | 4/1993 | Srubas et al. | 219/549 |
| 5,218,185 | | 6/1993 | Gross | 219/528 |
| 5,403,992 | * | 4/1995 | Cole | 219/528 |
| 5,465,013 | | 11/1995 | Bassen et al. | 307/91 |
| 5,521,358 | | 5/1996 | Eilentropp | 219/549 |
| 5,811,765 | * | 9/1998 | Nakagawa et al. | 219/212 |
| 6,002,117 | * | 12/1999 | Pak | 219/549 |
| 6,111,233 | * | 8/2000 | Rock et al. | 219/211 |
| 6,153,856 | * | 11/2000 | Lee | 219/212 |

* cited by examiner

*Primary Examiner*—Teresa Walberg
*Assistant Examiner*—Fadi H. Dahbour
(74) *Attorney, Agent, or Firm*—Lee & Hong

(57) ABSTRACT

An electrical heating pad for use with an ungrounded source voltage comprises a heating element arranged in the heating pad and defining a substantially coplanar plane and a fabric outer cover co-planarly enclosing the heating element. The heating element includes a first core made of an insulating material; a first conductive element wound around the first core using the first core as an axis; a second core made of an insulating material arranged in surrounding relation to the first core and the first conductive element; and a second conductive element wound around the second core using the second core as an axis. The first and second conductive elements are connected to each other at one ends and are connected to the ungrounded source voltage at the other ends to at least partially cancel out magnetic field generated from each conductive element. There is at least one shield layer located at one side of the coplanar plane defined by the heating element for substantially shielding electric field. In the heating pad, the second conductive element preferably generates more heat than the first conductive element. In that regard, the second conductive element has a lower total resistance than the first conductive element.

20 Claims, 6 Drawing Sheets

74a
79
200
120
275
220
221
222
211
212
210
74b
82
78

ELECTROMAGNETIC FIELD SHIELDING ELECTRIC HEATING PAD

This is a continuation-in-part of application Ser. No. 09/192,957 filed on Nov. 16, 1998, which is a continuation-in-part of application Ser. No. 08/785,981 filed on Jan. 27, 1997, now U.S. Pat. No. 5,837,971, all of which are fully incorporated herein by reference.

BACKGROUND OF THE INVENTION

1. Field of the Invention

This invention relates to electrically heated pads, and more particularly to electrical pads having a heating element that eliminates magnetic field being emitted from heating wires.

2. Discussion of the Related Art

It has been discovered that electromagnetic fields affect biological matter and, consequently, cause health problems in human. Such health problems may be linked to cancer and other ailments. The electromagnetic fields are very common in modern society where consumer electric appliances are frequently used at homes and offices. Commonly, electromagnetic fields are generated by power lines and transformers. The electric blankets or pads which we use to keep warm also generate one or more forms of electromagnetic field, which includes magnetic field. In fact, some studies have shown that there may be a direct correlation between electric blankets and certain medical conditions.

As it is well known that the electromagnetic field permeates through practically every kind of substances with the exception of ferromagnetic materials. Thus, attempting to block electromagnetic field in such appliances as electric blanket using ferromagnetic materials may not be practical due to its cost.

For example, FIG. 1 is a block diagram of a temperature controller and a heating element of a conventional electric blanket. The temperature controller 10 includes a bimetal thermostat switch 12 which can be set to appropriate temperatures to provide current to the heating element 20. Alternatively, as shown in FIG. 2, the temperature controller 10 may include an integrated circuit switch 14 instead of the thermostat switch 12 to provide the same function. The common characteristic of both FIGS. 1 and 2 is that the output voltage Vout at node 18 comprises a sinusoidal wave alternating current (AC). When using a conventional household line voltage, the Vout will be 60 Hz wave with peak voltage slightly higher than 120V. The output voltage Vout is connected to the heating element 20. The heating element 20 is made with a resistive wiring 22 which produces heat when electricity is applied. Furthermore, the devices shown in FIGS. 1 and 2 use a resistive wiring 22 which is arranged to produce magnetic and electromagnetic field which may be harmful to human.

SUMMARY OF THE INVENTION

Accordingly, the present invention is directed to an electrical heating pad that substantially obviates one or more of the problems due to limitations and disadvantages of the related art.

An object of the present invention is to provide an improved electrical heating pad substantially eliminating magnetic fields generated from the heating wires.

Another object of the present invention is to substantially eliminate electric fields by providing conductive shielding around the heating element.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an electrical heating pad for use with an ungrounded source voltage comprises a heating element arranged in the heating pad and defining a substantially coplanar plane and a fabric outer cover coplanarly enclosing the heating element. The heating element includes a first core made of an insulating material; a first conductive element wound around the first core using the first core as an axis; a second core made of an insulating material arranged in surrounding relation to the first core and the first conductive element; and a second conductive element wound around the second core using the second core as an axis. The first and second conductive elements are connected to each other at one ends and are connected to the ungrounded source voltage at the other ends to at least partially cancel out magnetic field generated from each conductive element.

According to one aspect of the present invention, the heating element further comprises an insulating cover that covers the second core and the second conductive element. Preferably, there is at least one shield layer located at one side of the coplanar plane defined by the heating element for substantially shielding electric field. Alternatively, there are two shield layers, each shield layer being located at one side of the coplanar plane defined by the heating element for substantially shielding electric field, wherein both shield layers are electrically connected to each other.

According to another aspect of the present invention, the first core is made of glass fibers, and the second core is made with silicone. The conductive wire is preferably made with copper having a non-conductive coating. Moreover, the first and second cores are made of a material with high heat transmitting coefficient.

According to another aspect of the present invention, the second conductive element preferably generates more heat than the first conductive element. In that regard, the second conductive element has a lower total resistance than the first conductive element. In particular, the first conductive element, when measured at both ends, has resistance of about 60–80 Ohms. The second conductive element, when measured at both ends, has resistance of about 20–40 Ohms. The first and second conductive elements has a series resistance of about 80–120 Ohms.

According to another aspect of the present invention, the shield layer is a wire mesh made of conductive wire. Alternatively, the shield layer is a conductive sheet.

These and other aspects, features and advantages of the present invention will be better understood by studying the detailed description in conjunction with the drawings and the accompanying claims.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

With reference to the drawings, and in particular to FIGS. 3–11 thereof, a heating pad 120 used in the electric blanket embodying the principles and concepts of the present invention will be described.

Figures 3A, 3B:
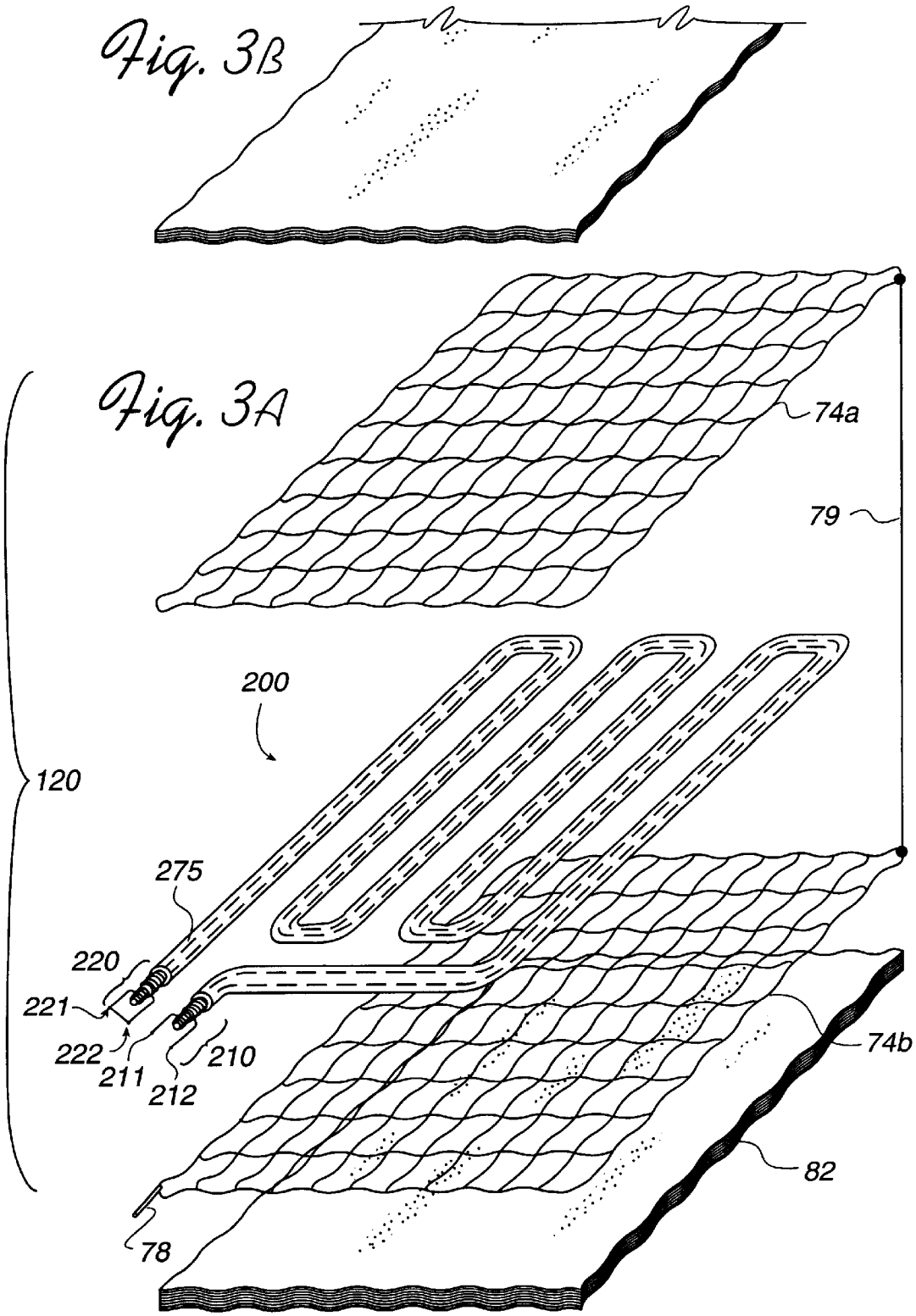
FIG. 3A illustrates a schematic diagram of a preferred embodiment of an electrical heating pad.
FIG. 3B illustrates a conductive sheet used in lieu of the shielding meshes shown in FIG. 3A.

FIG. 3A illustrates the preferred embodiment of the heating pad 120 of the present invention. The heating pad 120 includes a coaxial like heating element 200 preferably arranged between an upper shield 74*a* and a lower shield 74*b*. However, the heating pad 120 may only comprise the heating element 200 without the shields 74*a* and 74*b* or alternatively with only one of the shields 74*a* or 74*b*. The heating element 200 is arranged in a zig-zag or meandering fashion to define substantially a co-planar plane. The heating element 200 is a resistive wiring which produces heat when electrical current is provided. The heating pad 120 is energized using either an alternating or direct current source. One of the sources for the alternating current (AC) is a common household electric outlet which provides a voltage source of 110 v and 60 Hz. Alternatively, a direct current (DC) source may be provided by using an AC to DC converter, which is described below.

Although the use of direct-current as a power supply to the heating element 70 reduces the effect of electromagnetic field, to further reduce the electromagnetic field generated from the heating element 200, a pair of shield 74*a* and 74*b* may be used, as shown in FIG. 3A. In particular, the shields 74*a* and 74*b* are made preferably with copper or other suitable materials to substantially block the electromagnetic field emitted from the heating element 200. The shields 74*a* and 74*b* may take many forms and shapes. The shields 74*a* and 74*b* shown in FIG. 3A is in the form of a mesh. Other suitable type of shields known to one of ordinary skill in the art may be used, such as thin aluminum or copper foil. For example, FIG. 3B illustrates a conductive sheet used in lieu of the shielding meshes shown in FIG. 3A. The shields 74 are then covered with a fabric material 84, such as cotton. The whole assembly may then be covered with a resilient fabric cover 82 to form a blanket or a comforter.

The shields 74*a* and 74*b*, which are preferably made with thin copper wires, are webbed to form a substantially flat and flexible mesh. In the preferred embodiment, the conductive wire of the shields 74*a* and 74*b* consists of a multiple, such as five (5), strands of twisted conductive wires, each wire having a diameter of about 0.005 mm, for increased resiliency and flexibility. The shields 74*a* and 74*b* are positioned so that the first shield 74*a* is preferably above and the second shield 74*b* is below the heating element 200. The purpose of a connecting wire 79 is to illustrate that the first shield 74*a* and the second shield 74*b* are electrically connected to each other. Preferably, when the heating element 70 is constructed, the first and second shields 74*a* and 74*b* may be joined at the edges to form a fully conducting envelope where the resistive wiring 72 can be inserted. The terminal 78 is preferably connected to the ground to discharge any current build-up from electromagnetic field and/or static electricity. This way the possibility of electric shock by an exposed wire in the heating element 200 is eliminated because such wire cannot be exposed without it being short circuited by the shield 74*a* or 74*b*.

In the first and second shields 74*a* and 74*b*, the gap between each thread of wire may be adjusted dependent upon the frequency of the electromagnetic field generated from the heating element 200. For example, if the present invention is used with 120V line voltage at 60 Hz, then the gap between each wire should preferably be about 5 to 10 mm. In an alternative embodiment of the present invention, the shield 74 may be made of a flexible foil or a cloth sprayed or coated with a conductive material.

FIG. 3A also shows the heating element 200 according to the preferred embodiment of the present invention. The coaxial type heating element 200 is arranged in a zig-zag form between two shields 74*a* and 74*b*. Alternatively, the heating element 200 may be laid out generally in a rectangular or circular form, or other suitable form known to one of ordinary skill in the art. As an added comfort, one or more layers of cloth or fabric materials may be inserted between the heating element 200 and the shields 74*a* and 74*b*. The heating element 200 includes an input portion 210 and a terminating portion 220. Both portions are shown as exposed in FIG. 3 for the purpose of describing their embodiments. However, during actual use, the both ends of the heating element 200 are preferably covered with any suitable protective cover to prevent short circuit of internal conductive wires.

The input portion 210 of the heating element 200 has two input leads 211 and 212 for receiving electric current thereto. The terminating portion 220 also has two leads 221 and 222 which are connected to each other to complete a conductive loop defining the heating element 200. The detailed description of the heating element will be described with respect to FIGS. 4 and 5.

Figure 4:
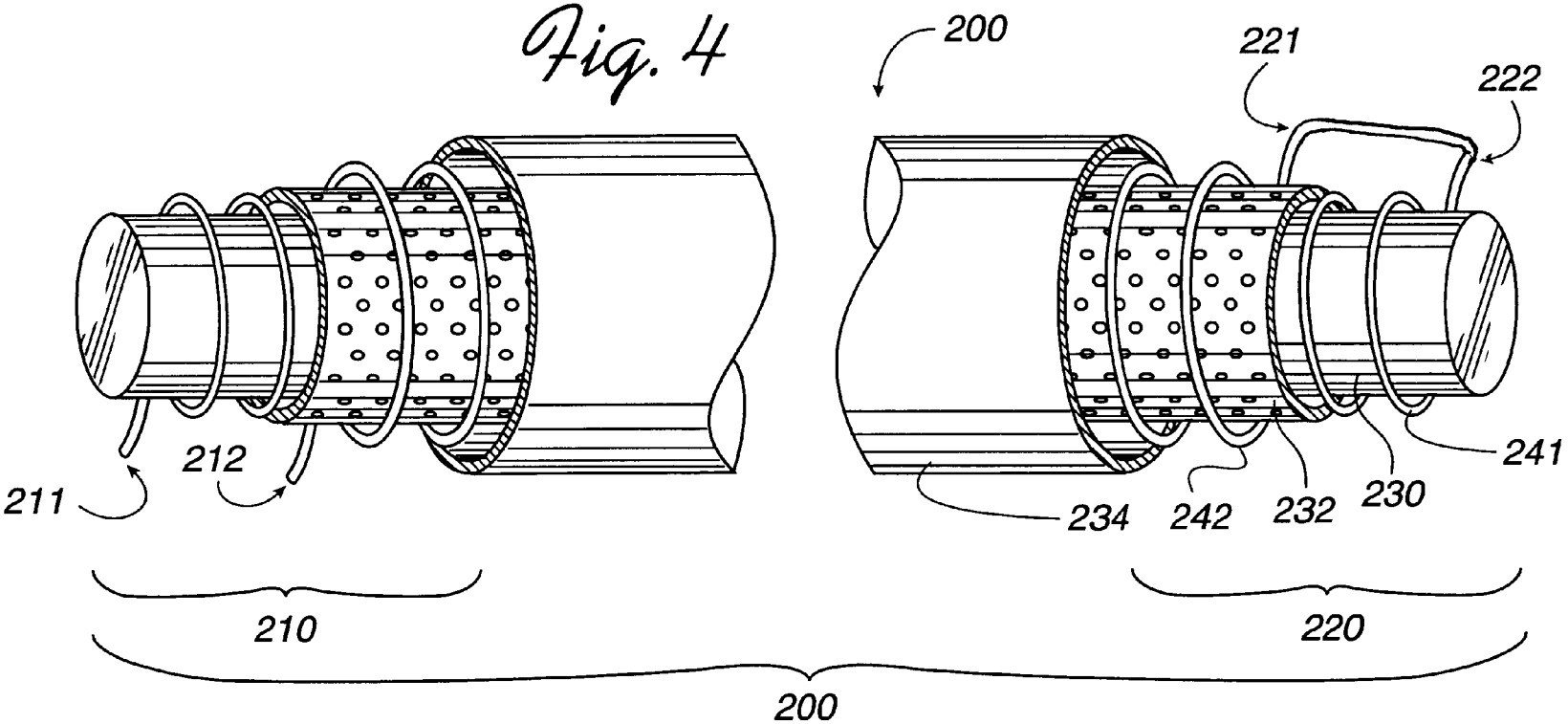
FIG. 4 illustrates an heating element according to the present invention.

FIG. 4 illustrates the input portion 210 and the terminating portion 220 of the heating element 200 according to the present invention. The heating element 200 includes a first core 230, a second core 232 arranged in a surrounding relation and preferably substantially covering the first core, and a protective cover or layer 234 covering both the first and second cores 230 and 232. The second core 232 and the protective cover 234 are preferably made with any suitably flexible and resilient material, such as silicone, rubber or plastic composite material. Preferably, the materials used for the first and second cores 230 and 232 and the protective cover 234 should be made with a heat conductive material or materials that have a high heat transmission coefficient.

Using the first core 230 as an axis, a first resistive wire or heating wire 241 is firmly and spirally wrapped around the first core 230. When spirally wrapped, the separation distance between the first resistive wire 241 may depend on the input frequency and the voltage to effectively cancel the magnetic field generated from a second resistive wire 242. The first core 230 and the first resistive wire 241 are then covered with the second core 232. Using the second core 232 as an axis, a second resistive wire or heating wire 242 is firmly and spirally wrapped around the second core 232. As shown in the terminating portion 220 of the heating element 200, the two leads 221 and 222 are electrically connected to each other. In such construction, the resistive wires 241 and 242 become one continuous heating wire.

The second core 232 is made with any suitable flexible insulator or other suitable material known to one of ordinary skill in the art. Preferably, the second core is made of silicon rubber that is not a positive-temperature-coefficient (PTC) material. A PTC material usually increases resistance when temperature is increased.

In the preferred embodiment of the present invention, there is no aluminum foil layer disposed in surrounding relation to the first resistive wiring 241 for purposes of shielding electric field. The entire structure is then coated with a flexible insulating cover 234, such as rubber or silicone composite, to shield from outer environment.

When spirally wrapped, the separation distance between the second resistive wire 242 depends on the input frequency and the voltage to effectively cancel the magnetic field generated from the first resistive wire 241. Preferably, the first and second resistive wires 241 and 242 are identical. In the preferred embodiment of the present invention, the first core 230 is about 0.8 mm in diameter, the second core 232 is about 2.2 mm in diameter and the cover 234 is about 3.4 mm in diameter. Each one of the first and second resistive wire 241 and 242 is about 0.2 mm in thickness.

The number of windings of either the first resistive wire 241 or the second resistive wire 242 may preferably be about 20 to 100 turns per inch. Such number of turns eliminates about 90% to 95% of magnetic field generated from the wires. The first and second resistive wires 241 and 242 have a total series resistance of about 70 to 130 Ohms, and preferably about 100 Ohms, when measured from the two input leads 211 and 212. Because the first resistive wire 241 is located near the core and the second resistive wire 242 is located near the surface of the heating element 200, a higher resistance is required in the first resistive wire 241 to reduce amount of heat emitting therefrom. Preferably, the amount of heat generated by both wires is about 30% to 45% from the first resistance wire 241 and about 70% to 55% from the second resistive wire 242. In other words, it is preferable that more heat is generated from the second resistive wire 242. There are various ways to generate such uneven heat. For example, wires having different thickness, thus different resistance, may be used. A preferred way is to use a longer wire for the first resistive wire 241 by having more turns per inch than that of the second resistive wire 241. As a result, the resistance measured from each end of the first resistive wire 241 is about 55 to 80 Ohms, and preferably about 60 to 70 Ohms. The resistance measured from each end of the second resistive wire 242 is about 20 to 45 Ohms, and preferably about 30 to 40 Ohms, to provide a total resistance of about 100 Ohms.

Figure 5:
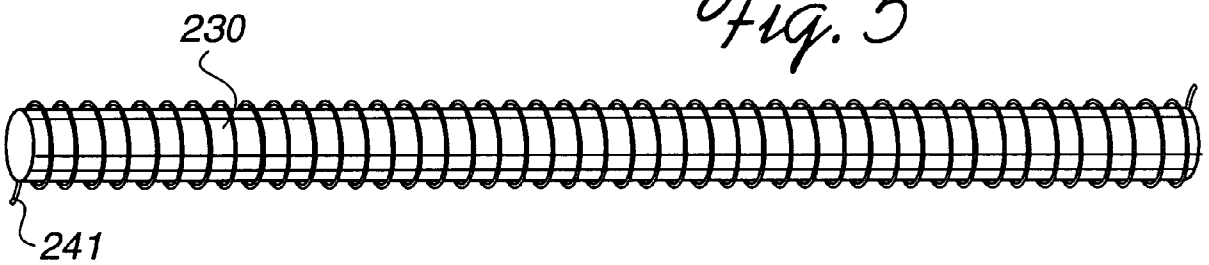
FIG. 5 illustrates a resistive wire used in the heating element of the present invention.

FIG. 5 illustrates the first core 230 with the first resistive wire 241 wrapped thereon. The first core 230 is preferably made of a plurality of glass fiber or thread having characteristics of flexibility and resiliency, such as cotton, nylon. The first resistive wire 241 is preferably made with at least a single strand of copper or nickel-chromium wire that is coated with varnish or enamel to prevent short circuiting with the second resistive wire 242. Similarly, the second resistive wire 242 is made identical to the first resistive wire 242 with the same non-conductive coating. A resistive wire 241 or 242 having a different diameter may be used to generate more heat or to accommodate higher wattage.

Figure 1:
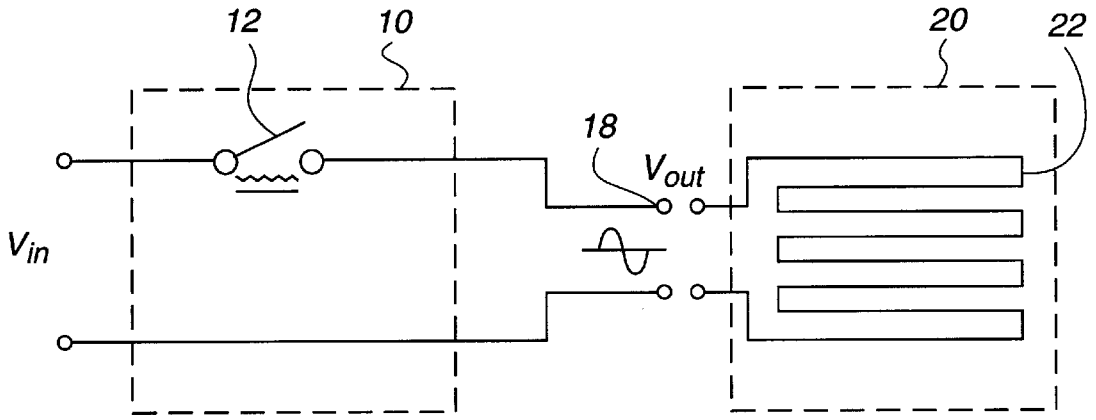
Fig. 1 (Prior Art)
FIG. 1 illustrates a schematic diagram of a prior art electric blanket.
Figure 2:
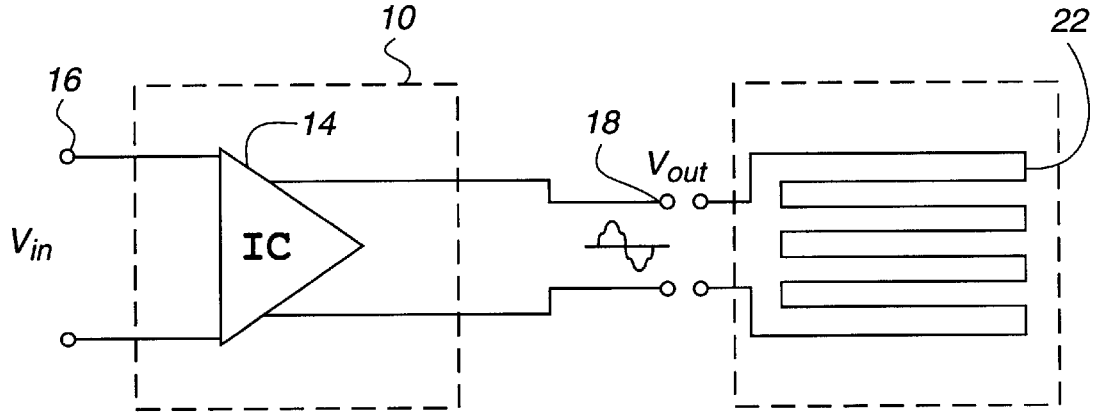
Fig. 2 (Prior Art)
FIG. 2 illustrates a schematic diagram of a prior art electric blanket using a different type of temperature controller.

As described above, the heating pad 120 according to the present invention can be used with both alternating and direct current source. Because of the construction of the heating element 200, magnetic fields are substantially eliminated even when used with an alternating current source. When an alternating current source is used, the heating pad 120 is energized through a temperature controller generally known to one of ordinary skill in the art, for example, ones shown in FIGS. 1 and 2. When a direct current source is used, the heating pad 120 is energized through a temperature controller equipped with AC to DC converter.

Figure 6:
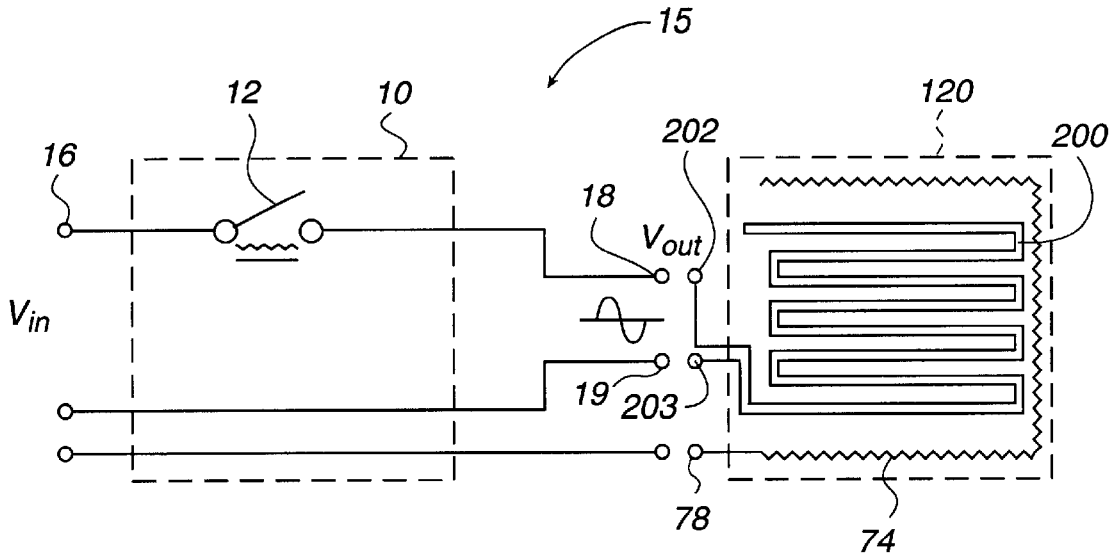
FIG. 6 illustrates a schematic diagram of the electric blanket using the electrical heating pad according to the present invention and a bimetal temperature controller.

FIG. 6 shows a schematic diagram of the electric blanket 15 using the heating pad 120 of the present invention with a temperature controller 10 providing alternating current to the heating pad 120. The temperature controller 10 is well known in the art and is provided to control the voltage between terminals 18 and 19 (denoted as Vout) with a thermal switch 12. The thermal switch 12 is designed and configured for a variable temperature setting by a user. The thermal switch 12 is preferably made of a bimetal, which is a laminate of two dissimilar metals having different coefficients of thermal expansion bonded together.

The output voltage from the temperature controller 10 (Vout), which typically is sinusoidal wave alternating current, is provided to inputs 202 and 203 of the heating pad 120. Alternatively, the output voltage from the temperature controller 10 may be provided to an energy-storage element (not shown) to smooth out the time variations of the waveform. This is achieved by capacitors and resistors. Capacitance and resistance of suitable values may be used dependent upon the line voltage Vin. More sophisticated filter circuits do better jobs of smoothing than capacitors. The output voltage Vout provided to the heating pad 120 is converted into heat by the heating element 200.

Figure 7:
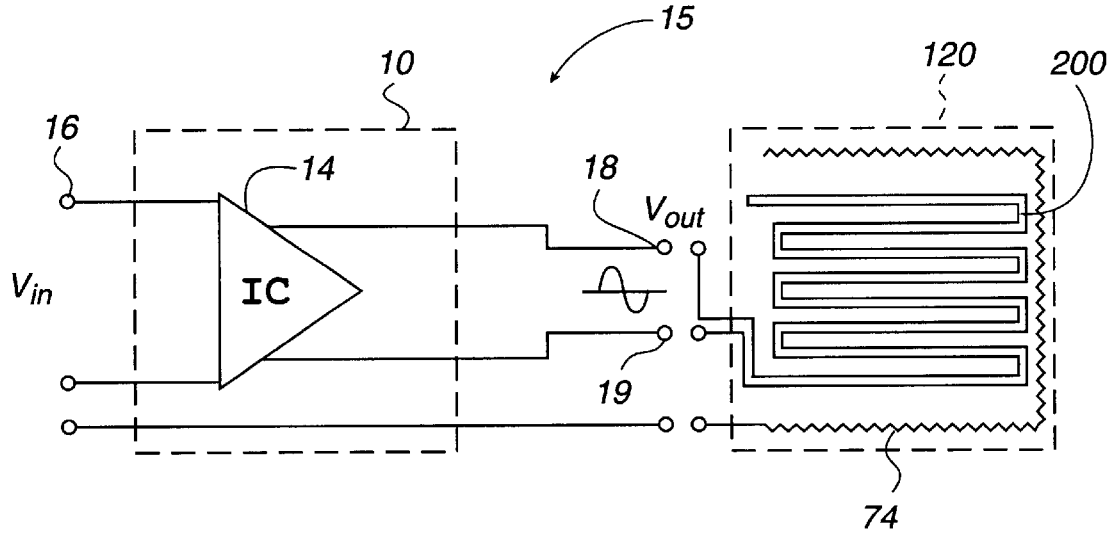
FIG. 7 illustrates a schematic diagram of the electric blanket using the electrical heating pad according to the present invention and an IC temperature controller.

Alternatively, as shown in FIG. 7, the electric blanket 15 has a temperature controller 10 in the form of an integrated circuit switch 14 instead of the thermostat switch 12 to provide the same function. The heating pad 120 of the electric blanket 15 shown in FIG. 4 has the identical structure to that of FIG. 6.

Figure 8:
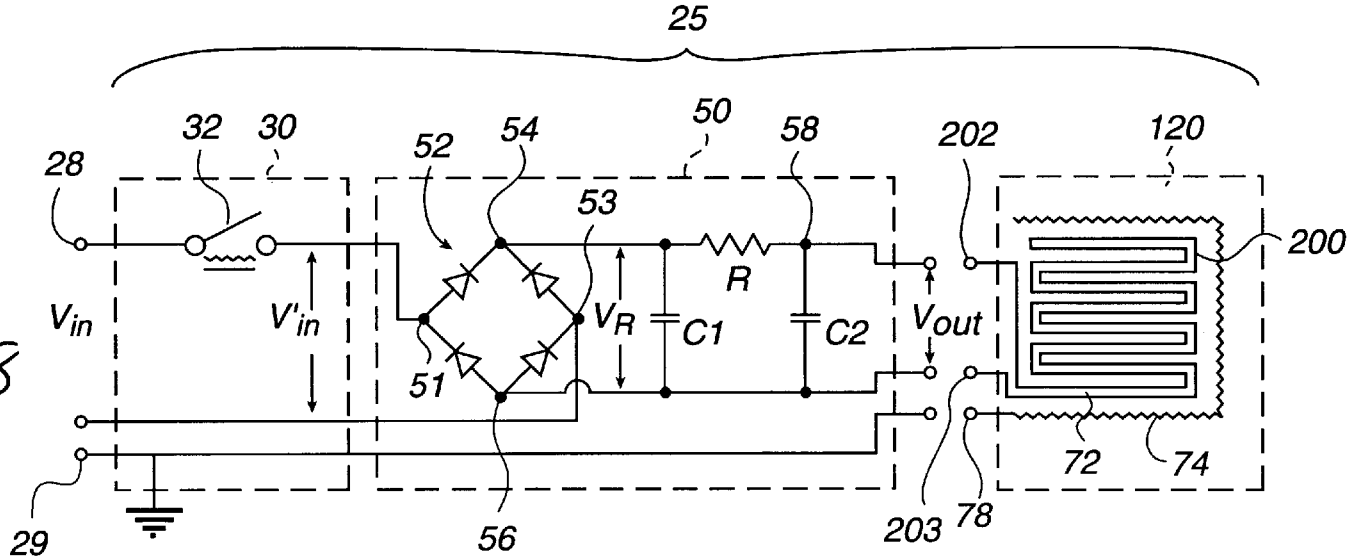
FIG. 8 illustrates a schematic diagram of the electric blanket using a DC voltage source to energize the heating pad.
Figure 9:
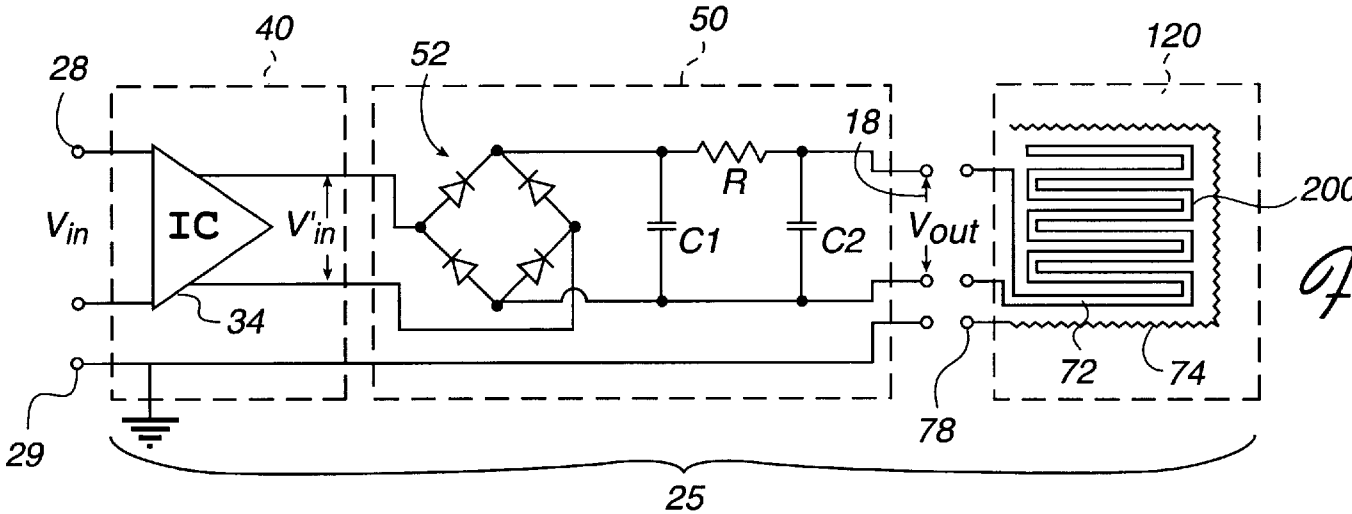
FIG. 9 illustrates a schematic diagram of another embodiment of the electric blanket using a DC voltage to energize the heating pad.

FIGS. 8 and 9 show schematic diagrams of the electric blanket 25 using the heating pad 120 of the present invention with a temperature controller 30 having a AC to DC converter 50. While the heating pad 120 shown in FIGS. 6 and 7 operates with alternating current, the heating pad 120 of FIGS. 8 and 9 uses direct current as its energy source. The temperature controller 30 is well known in the art and is provided to control the voltage between terminals 51 and 53 (denoted as Vin) with a thermal switch 32. The thermal switch 32 is designed and configured for a variable temperature setting by a user. The thermal switch 32 is preferably made of a bimetal, which is a laminate of two dissimilar metals having different coefficients of thermal expansion bonded together.

The output voltage from the temperature controller 30 (Vin), which is alternating current, is provided to inputs 51 and 53 of a full-wave rectifier 52 comprising four diodes forming a ring as shown in FIG. 8. In this embodiment, a suitable full-wave rectifier 52 should be chosen to withstand a peak voltage in excess of the input line voltage Vin at node 28. The purpose of the full-wave rectifier 52 is to carry out AC to DC conversion for the purpose of supplying a constant voltage to the heating element 200. As an alternative embodiment of the present invention, a half-wave rectifier may be used in lieu of the full-wave rectifier 52. In particular, each diode of the full-wave rectifier 52 has a minimum operating range of about 3 amps and 250 to 400 volts, but other suitable diodes or the like may be used.

After converting the AC to DC using the full-wave rectifier 52, the next step involves an energy-storage element to smooth out the time variations of the rectified waveform. This is achieved by capacitors C1 and C2 and R. Capacitance and resistance of suitable values may be used dependent upon the line voltage Vin and operating characteristics of the full-wave rectifier 52. For example, in the second embodiment, for a line voltage Vin of 120V (which is a common household line voltage), the value of C1 and C2 may be about 100–200 $\mu$F and R may be about 2–5 Ohms at 10 watts, but other suitable values can be used. More sophisticated filter circuits do better jobs of smoothing than capacitors. Alternatively, a regulator circuit (not shown) may be used in lieu of the resistor R for additional smoothing and to steadily maintain the DC voltage level despite variations of current demanded by the load.

The output voltage Vout provided to the heating pad 120 is converted into heat by the heating element 200. The construction of the heating pad 120 in FIGS. 8 and 9, which is described above in detail, is identical to one shown in FIGS. 6 and 7.

Figure 10:
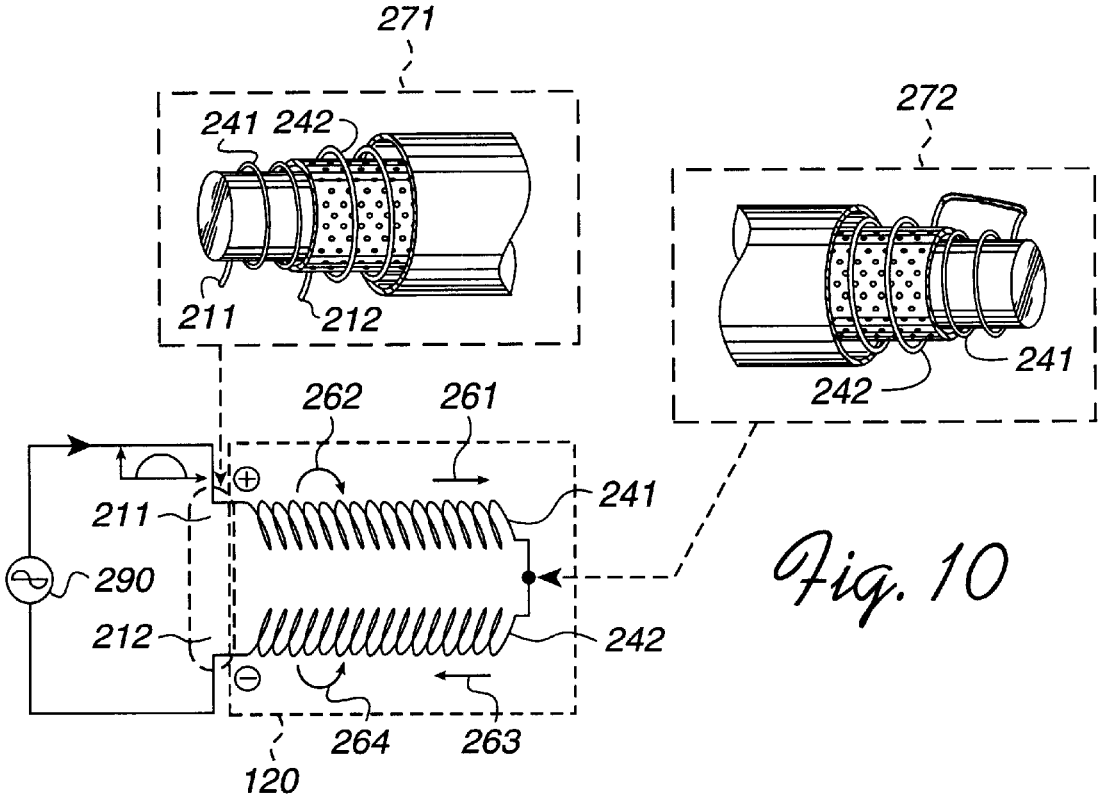
FIGS. 10 and 11 illustrate current and magnetic field direction in the heating element according to the present invention.
Figure 11:
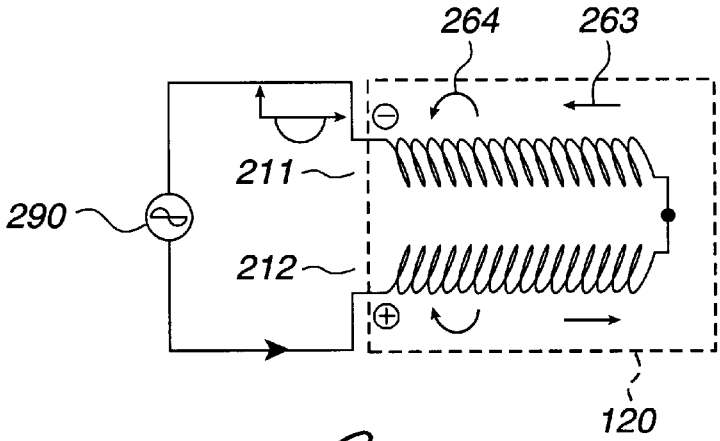

The operation of the present invention will now be described with respect to FIGS. 10 and 11. FIGS. 10 and 11 illustrate the current and magnetic field direction of the electric blanket according to the present invention when alternating current is used as an input source. In particular, FIG. 10 illustrates current and magnetic field directions when a positive voltage is applied to the heating element 120, while FIG. 11 illustrates current and magnetic field directions when a negative voltage is applied. The two input leads 211 and 212 are connected to the ungrounded source voltage 290, which is preferably alternating current commonly found in household electric outlets. More particularly, the heating element 200 is connected to alternating current which is not grounded. The preferred embodiment of the present invention substantially eliminates magnetic field produced from the heating element 200 without using connections to the ground but only using two resistive wires 241 and 242 providing currents concurrently travelling in opposite directions.

A diagram 271 illustrates the input portion 210 of the heating element and a diagram 272 illustrates the terminating portion 220. The current arrow 261 represents the direction of the current, while the magnetic field arrow 262 represents the direction of the magnetic field according to the right-hand rule.

When the current flows from left to right in the first resistive wire 241 as in FIG. 10, the magnetic field direction in the first resistive wire 241 is in a clockwise direction as indicated by the arrow 262 in accordance with the right-hand rule. Because the first and second resistive wires 241 and 242 are connected at the terminating portion of the heating element, as shown in diagram 272, the current in the second resistive wire 242 flows from right to left as in FIG. 10. As a result, the magnetic field direction in the second resistive wire 242 is in a counter-clockwise direction as indicated by the arrow 264. Therefore, the clockwise magnetic field generated by the first resistive wire 241 effectively and substantially cancels the counter-clockwise magnetic field generated by the second resistive wire 242. Consequently, the heating element 200 according to the present invention produces either no or very low magnetic field without having a ground connected to the heating element 200.

The above description in connection with FIG. 10 equally applies to the diagram shown in FIG. 11, except that the directions of current and the magnetic field are all reversed. However, the theory of operation remains the same.

Although the above description has been provided using an electric heating pad as an example, the present invention may be used in electric blanket, comforter, etc.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An electrical heating pad for use with an ungrounded source voltage, the heating pad comprising:

a heating element arranged in the heating pad and defining a substantially coplanar plane, the heating element including:

a first core made of an insulating material;

a first conductive element wound around the first core using the first core as an axis;

a second core made of an insulating material arranged in surrounding relation to the first core and the first conductive element; and a second conductive element wound around the second core using the second core as an axis, wherein the first and second conductive elements are connected to each other at one ends and are connected to the ungrounded source voltage at the other ends to at least partially cancel out magnetic field generated from each conductive element; and a fabric outer cover coplanarly enclosing the heating element.

2. The electrical heating pad of claim 1, the heating element further comprising an insulating cover that covers the second core and the second conductive element.

3. The electrical heating pad of claim 1, further comprising at least one shield layer located at one side of the coplanar plane defined by the heating element for substantially shielding electric field.

4. The electrical heating pad of claim 3, further comprising two shield layers, each shield layer being located at one side of the coplanar plane defined by the heating element for substantially shielding electric field, wherein both shield layers are electrically connected to each other.

5. The electrical heating pad of claim 1, wherein the first core is made of glass fibers.

6. The electrical heating pad of claim 1, wherein the first conductive element is made with copper having a non-conductive coating.

7. The electrical heating pad of claim 1, wherein the first and second cores are made of a material with high heat transmitting coefficient.

8. The electrical heating pad of claim 7, wherein the second core is made with silicone.

9. The electrical heating pad of claim 1, wherein the first conductive element, when measured at both ends, has resistance of about 60–80 Ohms.

10. The electrical heating pad of claim 1, wherein the second conductive element, when measured at both ends, has resistance of about 20–40 Ohms.

11. The electrical heating pad of claim 1, wherein the first and second conductive elements has a series resistance of about 80–120 Ohms.

12. The electrical heating pad of claim 1, wherein the second conductive element generates more heat than the first conductive element.

13. The electrical heating pad of claim 1, wherein the second conductive element has lower total resistance than the first conductive element.

14. The electrical heating pad of claim 1, further comprising a shield layer adjacent the heating element, wherein the shield layer is a wire mesh made of conductive wire.

15. The electrical heating pad of claim 1, further comprising a shield layer adjacent the heating element, wherein the shield layer is a conductive sheet.

16. An electrical blanket for use with an ungrounded source voltage, the blanket comprising:

a control device connected to the source voltage to control the source voltage in response to a predetermined temperature setting; and a heating pad comprising a heating element arranged in the heating pad, the heating element defining a substantially coplanar plane, the heating element including:

a first core made of an insulating material;

a first conductive element wound around the first core using the first core as an axis;

a second core made of an insulating material arranged in surrounding relation to the first core and the first conductive element; and a second conductive element wound around the second core using the second core as an axis, wherein the first and second conductive elements are connected to each other at one ends and are connected to the ungrounded source voltage at the other ends to at least partially cancel out magnetic field generated from each conductive element; and a fabric outer cover coplanarly enclosing the heating element.

17. The electrical blanket of claim 16, further comprising at least one shield layer located at one side of the coplanar plane defined by the heating element for substantially shielding electric field.

18. The electrical blanket of claim 17, further comprising two shield layers, each shield layer being located at one side of the coplanar plane defined by the heating element for substantially shielding electric field, wherein both shield layers are electrically connected to each other.

19. The electrical blanket of claim 17, wherein the first and second conductive elements has a series resistance of about 80–120 Ohms.

20. The electrical heating pad of claim 16, wherein the second conductive element has lower total resistance than the first conductive element.

* * * * *